United States Patent [19]

Satomi et al.

[11] 4,142,792

[45] Mar. 6, 1979

[54] ELECTROPHOTOGRAPHIC APPARATUS

[75] Inventors: Toyokazu Satomi; Yasuhiro Tabata, both of Tokyo, Japan

[73] Assignee: Ricoh Company, Ltd., Tokyo, Japan

[21] Appl. No.: 767,257

[22] Filed: Feb. 10, 1977

[30] Foreign Application Priority Data

| | | | |
|---|---|---|---|
| Feb. 13, 1976 | [JP] | Japan | 51-15263 |
| Feb. 13, 1976 | [JP] | Japan | 51-15264 |
| Feb. 17, 1976 | [JP] | Japan | 51-16392 |
| Feb. 17, 1976 | [JP] | Japan | 51-16394 |

[51] Int. Cl.[2] ..... G03G 15/00

[52] U.S. Cl. ..... 355/14; 118/7

[58] Field of Search ..... 355/14, 3 R, 3 DD; 118/6, 7

[56] References Cited

U.S. PATENT DOCUMENTS

| | | | |
|---|---|---|---|
| 3,413,063 | 11/1968 | Young | 355/14 |
| 3,690,760 | 9/1972 | Banks et al. | 355/14 X |
| 3,736,055 | 5/1973 | Davidge et al. | 355/14 |
| 3,752,573 | 8/1973 | Miller | 355/14 X |

*Primary Examiner*—R. L. Moses

*Attorney, Agent, or Firm*—Frank J. Jordan

[57] ABSTRACT

A large number of copies of a small original document such as a card are made quickly by forming electrostatic images of the document circumferentially spaced from each other on the periphery of a rotating photoconductive drum. The electrostatic images are repeatedly developed and the resulting toner images are transferred to respective copy sheets to form copies. In this manner, a number of copies equal to the number of electrostatic images on the drum are produced for each revolution of the drum. However, due to unavoidable discharge of the electrostatic images the same can only be developed a predetermined number of times if acceptable copies are to be produced. The present apparatus therefore comprises an automatic means for forming new electrostatic images when the original electrostatic images have been developed the predetermined number of times. The automatic means may be in the form of a counter, a timer or a voltage sensor. An indicator is energized when the last required set of electrostatic images has been formed so that the original document may be removed from the apparatus. The developing means is de-energized after the last required developing operation has been completed.

13 Claims, 8 Drawing Figures

ELECTROPHOTOGRAPHIC APPARATUS

BACKGROUND OF THE INVENTION

The present invention relates to an improved electrophotographic copying apparatus in which electrostatic images on a drum are repeatedly developed to produce a large number of copies of a single original document in a short period of time.

In the most basic electrophotographic copying apparatus a photoconductive drum or belt is electrostatically charged and radiated with a light image of an original document to form an electrostatic image of the document on the drum. A toner substance is then applied to the drum to develop the electrostatic image into a toner image which is subsequently transferred to a copy sheet. The toner image is thermally or otherwise fixed to the copy sheet to provide a permanent copy and any residual toner substance is removed from the drum in preparation for another copying cycle.

Whereas this copying method is satisfactory for copying large size documents, it is wasteful in copying small documents since the majority of the surface of the drum is not used. To increase the copying speed where a large number of copies of a single small document are to be produced, it has been proposed to form a number of electrostatic images of the document spaced form each other about the circumference of the drum and repeatedly develop the electrostatic images and transfer them to respective copy sheets. In this manner, a number of copies equal to the number of electrostatic images on the drum can produced for each revolution of the drum.

Although this method of repeatedly developing an electrostatic image finds its most efficient application with respect to producing a large number of copies of a single small document, it is also beneficial to incorporate the method into a copying apparatus in which the actual copying operation is performed during a first revolution of the drum and the drum is cleaned during a second revolution thereof. In such an apparatus, the same magnetic brush which is used in the developing step during the first revolution of the drum is used to clean the drum during the second revolution thereof. By eliminating the necessity of cleaning the drum after each copy is produced, one copy can be produced for each revolution of the drum thereby increasing the copying speed by 100% in cases where more than one copy is desired from a single document.

In either type of copying apparatus embodying repeated development of an electrostatic image, a problem is encountered in that the electrostatic image can only be developed a certain number of times if acceptable copies are to be produced. This is because the electrostatic image partially discharges during each developing and transfer step. When the charge intensity or voltage of the electrostatic image drops below a certain value, copies of acceptable density and contrast can not be produced.

In prior art copying apparatus of this type, if a large number of copies are to be made of a single document, the apparatus operator must visually determined when the copy quality becomes unacceptable and manually control the apparatus to re-expose the drum for making the remaining copies. This procedure is wasteful since the operator will usually wait until the copy quality becomes unacceptable and throw away the unacceptable copies before initiating another exposure operation.

Such prior art apparatus generally gives no indication when the exposure operation is completed, and the operator must wait until the entire copying operation is completed before removing the original document. This problem is particularly serious in a copying apparatus in which the original document is circulated for repeated exposure. Each time the document is fed through the apparatus the possibility for a jam is created.

Yet another problem exists in copying apparatus utilizing the method of repeated development of a number of electrostatic images of a small original document formed on a drum or belt. Where the number of images on the drum exceeds the number of copies remaining to be made, the developing means will not be de-energized until the drum completes the final revolution. In this manner, at least one electrostatic image will be developed but the resulting toner image will not be transferred to a copy sheet. Instead, the toner image will be transferred onto the surface of a transfer roller or belt and will result in double printing in subsequent copying operations. In addition, the cleaning unit will be overloaded. An even more serious result will occur if the original document is removed prior to a required exposure operation. The drum will not be exposed and a completely black image will be transferred to a copy sheet and/or transfer drum.

SUMMARY OF THE INVENTION

In accordance with the present invention, a large number of copies of a small original document such as a card are made quickly by forming electrostatic images of the document circumferentially spaced from each other on the periphery of a rotating photoconductive drum. The electrostatic images are repeatedly developed and the resulting toner images are transferred to respective copy sheets to form copies. In this manner, a number of copies equal to the number of electrostatic images on the drum are produced for each revolution of the drum. Due to the unavoidable discharge of the electrostatic images the same can only be developed a predetermined number of times if acceptable copies are to be produced. The present apparatus therefore comprises an automatic means for forming new electrostatic images when the original electrostatic images have been developed the predetermined number of times. In one form of the invention, the automatic means comprises a counter for counting the number of copies made. In another form of the invention, the automatic means comprises a timer. In yet another form of the invention, the automatic means comprises a voltage sensor for directly sensing the charge intensity of the electrostatic images on the drum. An indicator is energized when the last required set of electrostatic images has been formed so that the original document may be removed from the apparatus. The developing means is de-energized after the last required developing operation has been completed.

It is an object of the present invention to provide an electrophotographic apparatus in which an electrostatic image is repeatedly developed comprising automatic means for forming a new electrostatic image when the original electrostatic image has been developed so many times that acceptable copies can no longer be produced.

It is another object of the present invention to provide an electrophotographic apparatus which positively eliminates waste of copy sheets and operating time.

It is another object of the present invention to provide an electrophotographic apparatus which gives a visual indication when an original document may be removed therefrom.

It is another object of the present invention to provide an electrophotographic apparatus which automatically deenergizes a developing means thereof as soon as a last required developing operation is completed.

It is another object of the present invention to provide a generally improved electrophotographic copying apparatus.

Other objects, together with the foregoing, are attained in the embodiments described in the following description and illustrated in the accompanying drawing.

DESCRIPTION OF THE PREFERRED EMBODIMENTS

While the electrophotographic copying apparatus of the invention is susceptible of numerous physical embodiments, depending upon the environment and requirements of use, substantial numbers of the herein shown and described embodiments have been made, tested and used, and all have performed in an eminently satisfactory manner.

Figure 1:
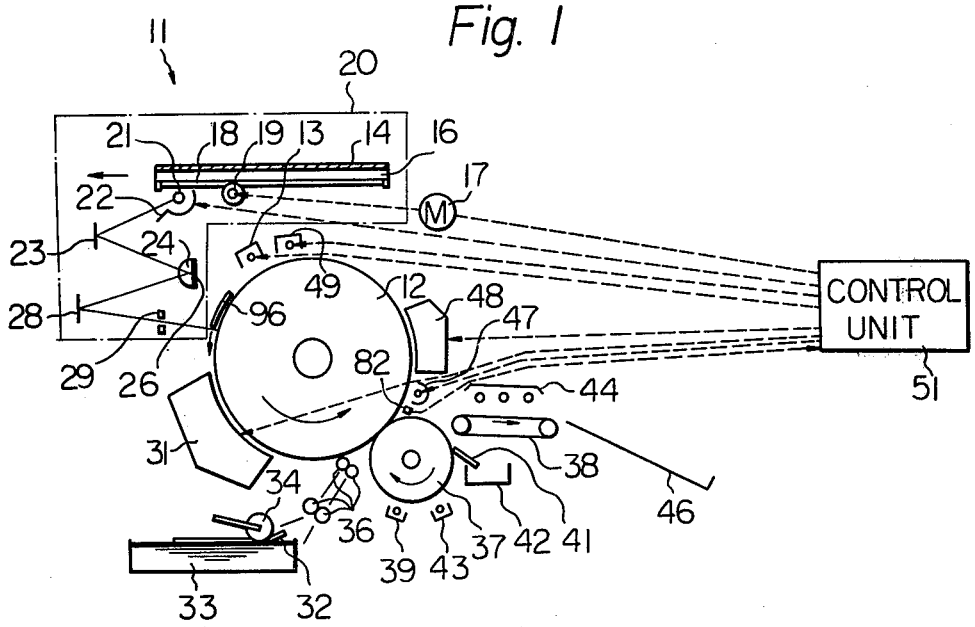
FIG. 1 is a schematic view of an electrophotographic copying apparatus embodying the present invention.

Referring now to FIG. 1 of the drawing, an electrophotographic copying apparatus 11 embodying the present invention comprises a photoconductive drum 12 which is rotated counterclockwise at a constant speed. The core (not designated) of the drum 12 is electrically conductive, is grounded and is formed on its periphery with a photoconductive layer (not shown).

A corona charging unit 13 is disposed adjacent to the surface of the drum 12 to electrostatically charge the same. An original document 14 which is to be electrostatically copied is placed face down on a transparent platen 16 which constitutes part of an exposure unit 20. A motor 17 moves the platen 16 and document 14 leftwardly in synchronism with the movement of the drum 12 through a rack 18 attached to the platen 16 and a pinion 19 driven from the motor 17 which engages with the rack 18. A lamp 21 illuminates the document 14 through the platen 16 and a light image of the document 14 is reflected from a mirror 22 and a mirror 23 through a converging lens 24 onto a mirror 26. From the mirror 26, the image is reflected back through the lens 24 from a mirror 28 through a slit 29 onto the surface of the drum 12.

The operation of the exposure means 20 forms an electrostatic image of the document 14 on the drum 12. More specifically, the light image causes localized photoconduction at the surface of the drum 12 so that the electrostatic charge applied to the drum 12 by the charging unit 13 is dissipated in light areas of the image.

A developing unit 31 preferably comprises a magnetic brush means (not shown) to apply a toner substance to the drum 12 which develops the electrostatic image into a toner image. Since the particular construction of the developing unit 31 is not the subject matter of the present invention, it is not shown or described in detail. In order to minimize discharge of the electrostatic image, the toner substance preferably comprises magnetized fine particles coated with an electrically insulative substance.

The toner particles adhere to the highly charged portions of the electrostatic image due to electrostatic attraction to form the toner image. After development, a copy sheet 32 is fed from a stack 33 by feed rollers 34 and 36 into contact with the drum 12 in such a manner that the leading edge of the copy sheet 32 aligns with the leading edge of the toner image. The copy sheet 32 is pressed between the drum 12 and a transfer roller 37 and guided therefrom onto a conveyor belt 38. An electrostatic charge is applied to an electrically insulative layer (not shown) on the periphery of the transfer roller 37 by a corona charging unit 39 which has the same polarity as the electrostatic image on the drum 12. The charge on the transfer roller 37 attracts the toner from the drum 12 onto the copy sheet 32 so that the toner image is transferred to the copy sheet 32. Residual toner and other particulate matter are removed from the transfer roller 37 by a scraper 41 and deposited into a container 42. A corona discharging unit 43 discharges the transfer roller 37 prior to recharging by the charging unit 39.

The conveyor belt 38 moves the copy sheet 32 under a fixing heater 44 which thermally fixes the toner image to the copy sheet 32 to form a permanent copy onto a discharge tray 46 from which the copy may be removed for use. A lamp 47 is energized to uniformly illuminate the drum 12 and discharge the same through photoconduction. A cleaning unit 48 removes residual toner from the drum 12 and a corona discharge unit 49 further discharges the drum 12 prior to recharging by the charging unit 13. The overall operation of the apparatus 11 is controlled by a control unit 51.

The basic operation of the apparatus 11 produces one copy for each revolution of the drum 12. The apparatus 11 is adapted, however, to make a number of copies of a small original document during each revolution of the drum 12. This operation will be described in detail below. In order to simplify the explanation of the apparatus 11, in the immediately following description it will be assumed that it is desired to make a large number of copies of the original document 14 but that only one electrostatic image thereof will be formed on the drum 12 and only copy will be produced for each revolution of the drum 12. However, the electrostatic image will be repeatedly developed in the manner described immediately below.

To make the first copy, the drum 12 is charged by the charging unit 13 and imaged by the exposure unit 20 to form the electrostatic image which is developed by the developing unit 31. The resulting toner image is transferred to the copy sheet 32. However, the lamp 47, cleaning unit 48 and discharging unit 49 are not energized so that the electrostatic image and a residual portion of the toner image remains on the drum 12. To form a second copy, the charging unit 13 and exposure unit 20 are not energized but the same electrostatic image is again developed by the developing unit 31. The resulting toner image is transferred to the next copy sheet on the stack 33. If the second copy is to be the last copy, the lamp 47, cleaning unit 48 and discharging unit 49 are energized. However, if another copy is to be made, the lamp 47 and units 48 and 49 are not energized, the same electrostatic image is developed and the resulting toner image transferred yet again. After the last copy has been produced, the lamp 47, cleaning unit 48 and discharging unit 49 are energized. It will be seen that the method comprises repeatedly developing an electrostatic image and transferring toner images produced through development of the electrostatic image to respective copy sheets.

Figure 2:
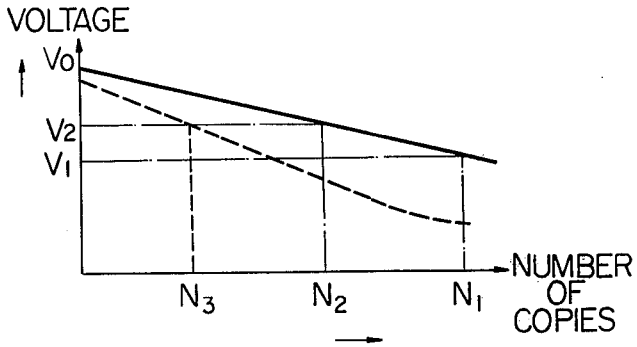
FIG. 2 is a graph showing the relationship between electrostatic image potential or voltage and the number of copies produced by the apparatus.
Figure 3:
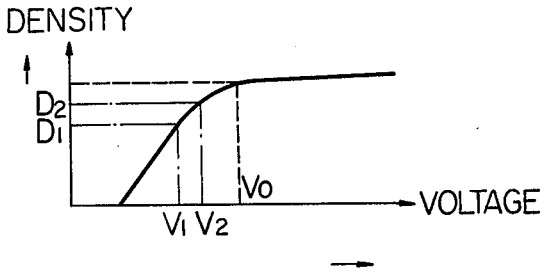
FIG. 3 is also a graph but shows the relationship between the copy image density and the number of copies produced by the apparatus.

Although an electrostatic image can be developed a number of times and still produce acceptable copies, there is a practical limit as determined by the particular configuration of the apparatus 11. In FIG. 2, a solid line curve shows the charge intensity or voltage of the electrostatic image as a function of the number of copies produced from the image. It will be seen that the voltage decreases with the number of copies or with operating time. The copies are still legible when the voltage has decreased from an initial value $V_0$ to a valve $V_1$ after $N_1$ copies have been made. However, the copy density $D_1$ as shown in FIG. 3 at the voltage $V_1$ is considerably lower than the original density $D_0$ at the voltage $V_0$ and the copy corresponding to the copy number $N_1$ is unacceptable from the standpoint of uniformity.

However, until the voltage decreases to $V_2$ when $N_2$ copies have been made and the copy density is $D_2$, the difference between the copies is so slight that the copies may be considered acceptably uniform. Therefore, it is desired to make only $N_2$ copies through development of a single electrostatic image.

Figure 4:
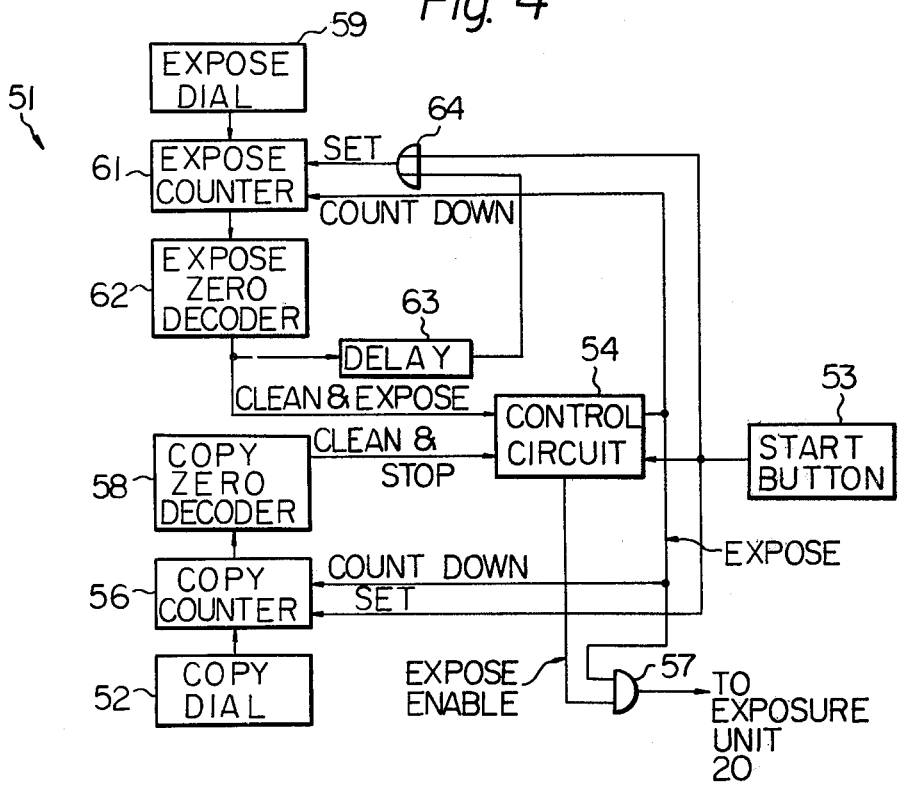
FIG. 4 is an electrical block diagram showing a first embodiment of a control unit of the apparatus.

A first embodiment of the control unit 51 which is designed to provide this function is shown in block form in FIG. 4. The control unit 51 comprises a copy dial 52 to which the apparatus operator sets the number of copies which are to be made of the original document 14. The copy dial 52 is connected to a copy counter 56. A start button or switch 53 is connected to an input of a control circuit 54 and also to a set input of the copy counter 56. Depression of the start button 53 to initiate a copying operation causes the number of copies set into the copy dial 52 to be input into the copy counter 56 so that the copy counter 56 is set to the number of copies.

To make the first copy, after depression of the start button 53 the control circuit 54 produces a high output on a line designated "expose" which leads to a count down input of the copy counter 56 and also to an input of an AND gate 57. Another output of the control circuit 54 is connected to another input of the AND gate 57 through a line designated "expose enable". The output of the AND gate 57 is connected to the exposure unit 20.

The control circuit 54 produces a high output on the "expose" line for a length of time required to expose the drum 12 to produce an electrostatic image thereon whenever the drum 12 is in the proper rotational position. The control circuit 54 produces a high output on the "expose enable" line only if the drum 12 is to be exposed. Thus, when the start button 53 is pressed the control circuit 54 produces high outputs on both the "expose" and "expose enable" lines and an original electrostatic image of the document 14 is formed on the drum 12. The control circuit 54 further controls the developing unit 31 and transfer roller 37 to develop the electrostatic image and transfer the resulting toner image to the copy sheet 32.

The count down input of the copy counter 56 is arranged to be triggered by the trailing edge of the high signal on the "expose" line which occurs when the exposure is terminated. Thus, the copy counter 56 is stepped down or decremented. The output of the copy counter 56 is connected to an input of a copy zero decoder 58 which produces a high output when the count in the copy counter 56 is zero. If only one copy is to be produced, the copy zero decoder 58 produces a high output immediately upon termination of the first exposure on a line designated "clean and stop" which leads to the control circuit 54. This actuates the control unit 54 to energize the lamp 47, cleaning unit 48 and discharging unit 49 during the first revolution of the drum 12 after the toner image is transferred to the copy sheet 32 and subsequently return the apparatus 11 to a standby condition in preparation for another copying operation. However, if more than one copy is to be produced, the copy zero decoder 58 will not produce a high output during the first revolution of the drum 12 and the lamp 47 and units 48 and 49 will not be energized. Furthermore, the control circuit 54 will not energize the charging unit 13 or exposure unit 20 during the next revolution of the drum 12 but will only energize the developing unit 31 and transfer roller 37. These operations will continue until the last copy has been made, the copy counter 56 is decremented to zero and the copy zero decoder 58 produces a high output.

The control unit 51 further comprises an expose dial 59 into which is set the number $N_2$, or the maximum number of acceptable copies which may be produced through repeated development of a single electrostatic image. The expose dial 59 is preferably located out of immediate sight inside the cover (not shown) of the apparatus 11 to prevent unauthorized tampering therewith by a person who does not understand its function. The expose dial 59 is connected to an expose counter 61 which is similar to the copy counter 56. The output of the expose counter 61 is connected to the input of an express zero decoder 62 which is similar to the copy zero decoder 58. The output of the expose zero decoder 62 is connected to an input of the control circuit 54 through a line designated "clean and expose". The output of the expose zero decoder 62 is further connected through a delay element 63 provided to prevent an indeterminate condition in the control unit 51 to an input of an OR gate 64. The output of the OR gare 64 is connected to a set input of the expose counter 61. The start button 53 is connected to another input of the OR gate 64. The "expose" line leading from the control circuit 54 to the count down input of the copy counter 56 also leads to a count down input of the expose counter 61.

Depression of the start button 53 causes the number $N_2$ to be set into the expose counter 61 and the expose counter 61 is decremented by a high output on the "expose" line simultaneously with the copy counter 56. If the number of copies to be made is less than $N_2$, the expose counter 61 will have no effect on the operation of the control circuit 54. However, if the number of copies to be made is greater than $N_2$, it is clear that if all of the copies produced are to be of acceptable quality the drum 12 must be re-exposed after $N_2$ copies are made.

This function is provided by the expose counter 61. After $N_2$ copies have been made, the count in the expose counter 61 becomes zero and the expose zero decoder 62 produces a high output on the "clean and expose" line. This controls the control circuit 54 to energize the lamp 47, cleaning unit 48 and discharging unit 49 after the toner image transfer operation for the $N_2$th copy and energize the charging unit 13 and exposure unit 20 during the next revolution of the drum 12. In this manner, a new electrostatic image is formed on the drum 12 which can be repeatedly developed to produce $N_2$ more copies. The high output on the "clean and expose" line is applied through the delay element 63 and OR gate 64 to the set input of the expose counter 61 causing the number $N_2$ to be again set into the expose counter 61. In this manner, unless the number of copies to be made is less than $2N_2$ the drum 12 will be exposed again after $2N_2$ copies have been made.

Figure 5:
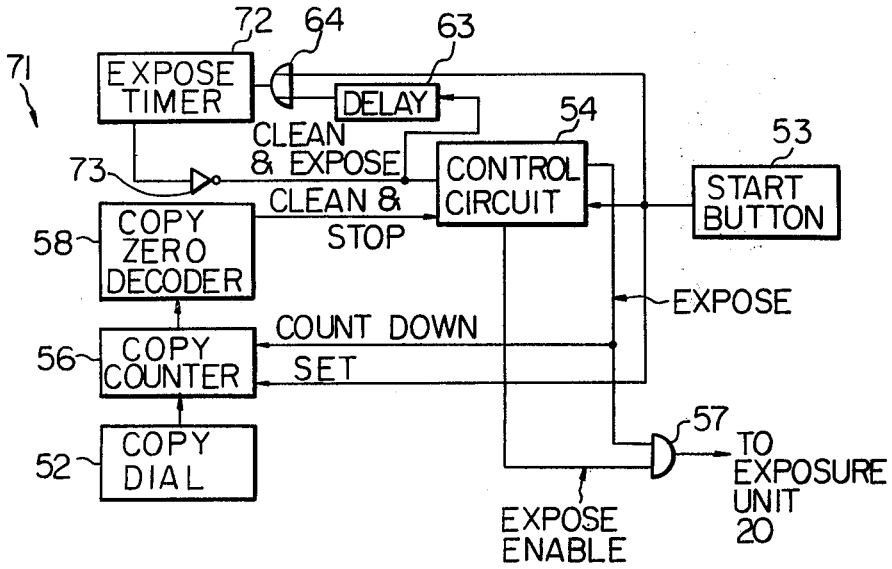
FIG. 5 is similar to FIG. 4 but shows a second embodiment of the control unit.

FIG. 5 shows another embodiment of the control unit 51 which is designated as 71. Like elements are designated by the same reference numerals and will not be described repetitiously. In the control unit 71, the expose counter 61 and associated circuitry are replaced by an expose timer 72 which may be advantageously embodied as a monostable multivibrator. The output of the expose timer 72 is connected through an inverter 73 to the "clean and expose" line. The output of the OR gate 64 is connected to the trigger input of the expose timer 72.

The pulse duration of the expose timer 72 is set to equal the length of time to make $N_2$ copies. The expose timer 72 is triggered through depression of the start button 53 and produces a high output which is inverted by the inverter 73 so that a low signal is applied to the "clean and expose" line. When the expose timer 72 times out after $N_2$ copies are produced, the expose timer 72 produces a low output which is inverted by the inverter 73 and applied to the "clean and expose" line thereby actuating the control circuit 54 to form a new electrostatic image on the drum 12. The high output on the "clean and expose" line is also applied to the trigger input of the expose timer 72 through the delay element 63 and OR gate 64 to re-trigger the expose timer 72. It will be understood from the above description that the control unit 71 produces the same results as the control unit 51.

Figure 6:
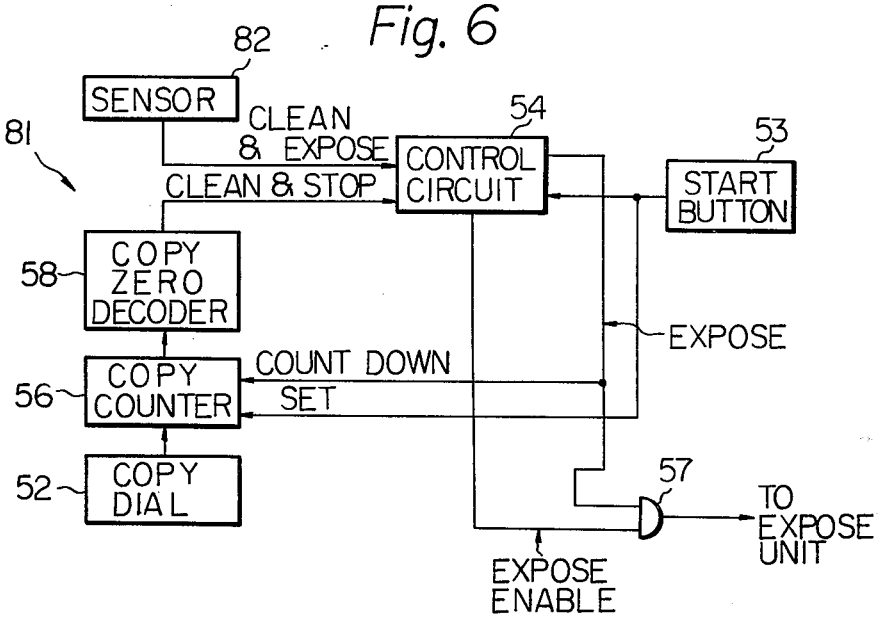
FIG. 6 is also similar to FIG. 4 but shows a third embodiment of the control unit.

FIG. 6 illustrates another control unit 81 in which a sensor 82 has an output connected to the "clean and expose" line. As viewed in FIG. 1, the sensor 82 is preferably provided closely adjacent to the drum 12 between the transfer roller 37 and the lamp 47. More specifically, the sensor 82 may be designed to sense the voltage of a marginal (non-image) area of the periphery of the drum 12 in which the photoconductive layer received no exposure. Alternatively, the sensor 82 may sense the average voltage or potential of the electrostatic image. As still another alternative, the sensor 82 may sense the optical density of the marginal area of the drum 12. However, no matter how the sensor 82 is configured it is designed to produce a high output after $N_2$ copies have been made at which time the voltage has dropped to $V_2$, thereby actuating the control unit 54 to re-expose the drum 12.

The control unit 81 is particularly suited for use in adverse environmental conditions in which the temperature and/or humidity reaches high values. In such an environment, the discharge of the electrostatic image occurs more quickly as indicated by a broken line curve in FIG. 2. It will be noted that the voltage is decreased to $V_2$ after only $N_3$ copies have been made. In this particular graph, $N_3$ is only about $\frac{1}{3}.N_2$. Therefore, the control unit 81 will re-expose the drum 12 after $N_3$ copies have been made, thereby ensuring acceptable copies under any environmental conditions.

As described hereinabove, it is desirable to provide the apparatus operator with an indication when the last required exposure of the drum 12 has been completed so that the original document 14 may be removed. This minimizes the possibility of a jam in a system where the original document 14 is recirculated and other undesirable effects. It also speeds up the operation of the apparatus since the operator may place a new original document in position on the platen 16 while the copying operation for the subsequent original document is being completed.

Figure 7:
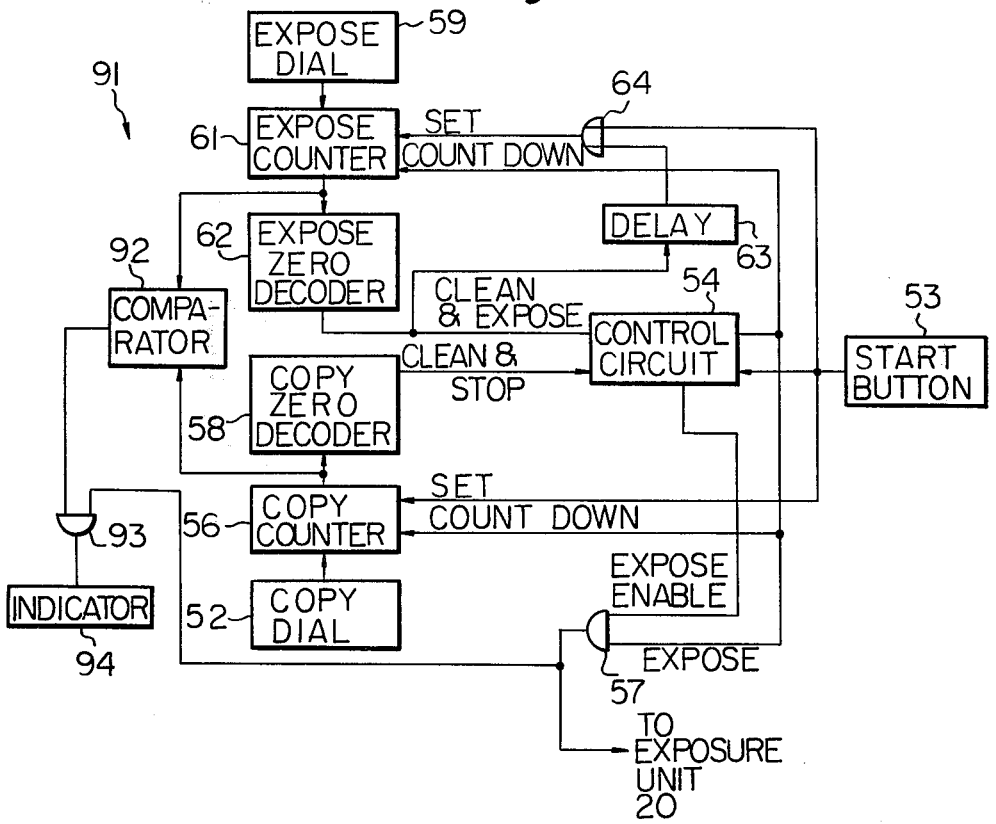
FIG. 7 is also similar to FIG. 4 but shows a fourth embodiment of the control unit.

This function is provided by a control unit 91 shown in FIG. 7 which is identical to the control unit 51 except for the provision of additional elements. In the control unit 91, the outputs of the expose counter 61 and the copy counter 56 are connected to inputs of a comparator 92 which is designed to produce a high output when the count in the copy counter 56 is lower than the count in the expose counter 61. The output of the comparator 92 is connected to an input of an AND gate 93, the output of which is connected to an indicator 94 which may be a buzzer or light. The output of the AND gate 57 is connected to another input of the AND gate 93.

The AND gate 57 produces a high output for energizing the exposure unit 20 to expose the drum 12. This high output is also applied to the AND gate 93 indicating that the drum 12 is being exposed. If the count in the copy counter 56 is higher than the count in the expose counter 61, it means that $N_2$ copies will be produced from the current electrostatic image before the required number of copies are produced, and that it will be necessary to expose the drum 12 at least one more time. In this case, the comparator 92 produces a low output and the indicator 94 is not energized.

However, if the count in the copy counter 56 is less than the count in the expose counter 61, it indicates that the exposure corresponding to the high output of the AND gate 57 is the last required exposure, and that the original document 14 may be removed after the completion thereof. The indicator 94 is designed to be energized by the trailing edge of the output signal of the AND gate 93, so that when the exposure is terminated and the output of the AND gate 93 goes from high to low, the indicator 94 will be energized. Although not shown, the control unit 91 is provided with means to turn off the indicator 94 after the copying operation is completed.

As viewed in FIG. 1, the output of the AND gate 93 may also be used to move a shutter 96 into the optical path between the exposure unit 20 and the drum 12 simultaneously with energizing the indicator 94. This prevents the drum 12 from being undesirably exposed if the operator should remove the original document 14 prior to the completion of the copying operation.

Rather than energize the indicator 94 upon completion of the last exposure, the control unit 91 may be adapted to raise or unlock a document retaining plate or de-energize a recirculating document feed mechanism to inform the operator that the original document may be removed and allow the operator to remove the document.

Figure 8:
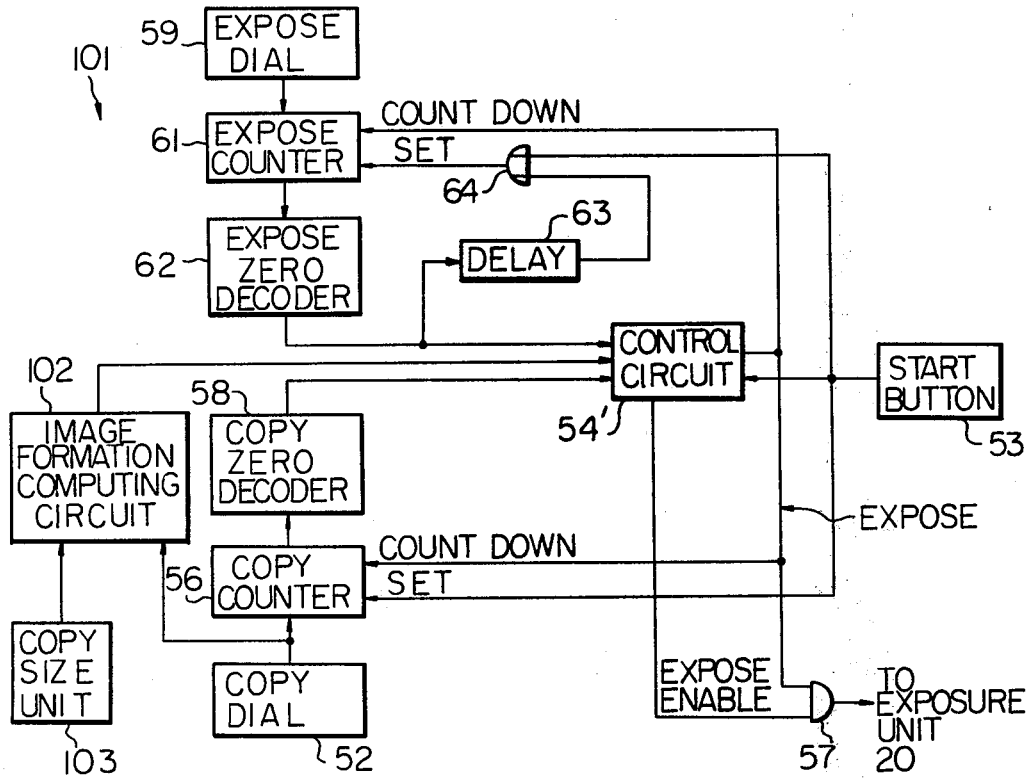
FIG. 8 is also similar to FIG. 4 but shows a fifth embodiment of the control unit.

Referring now to FIG. 8, a control unit 101 further comprises means for forming a plurality of images on the drum 12 in circumferentially spaced relation, thereby providing extremely fast copying in cases where a large number of copies are to be made of a small original document.

More specifically, the dimension of the original document which corresponds to the circumferential direction of the electrostatic image on the drum 12 must be less than one-half the circumference of the drum 12 so that two or more images may be formed on the drum 12. To achieve this function, the control unit 101 comprises an image formation computing circuit 102 which has an input connected to the copy dial 52 and an output connected to a modified control circuit 54'. A copy size unit 103 is also provided which has an output connected to the image formation computing circuit 102. Where one edge of the original document is aligned with an edge of the platen 16, the copy size unit 103 may comprise a pointer which the operator aligns with the opposite edge of the original document, although not shown. The pointer may be connected to the slider of a potentiometer which is similarly not shown so that an electrical voltage is fed to the image formation computing circuit 102 corresponding to the size of the original document. Based on the size of the original document and the number of copies to be produced, the image formation computing circuit 102 controls the control circuit 54' to form the optimum number of images on the drum 12 during two or more revolutions of the drum 12. During this process, only the charging unit 13 and the exposure unit 20 are energized at the proper times. After all of the images are formed, the image formation computing circuit 102 controls the control circuit 54' to begin developing the electrostatic images and transferring the resulting toner images to copy sheets. In this case, the control unit 54' is adapted to inhibit the output on the "expose line" until the first electrostatic image for development reaches the exposure position to prevent erroneous decrementation of the counters 56 and 61.

In other words, the operation of the control unit 101 is essentially similar to the operation of the control unit 51 except that two or more revolutions of the drum 12 are required to form all of the electrostatic images.

The control circuit 54' is further adapted to de-energize the developing unit 31 after the copy counter 56 is decremented to zero and the last electrostatic image has been developed. In a case where the number of electrostatic images on the drum 12 exceeds the number of copies to be made during the final revolution of the drum 12, this provision prevents transfer of a toner image resulting from development of an electrostatic image succeeding the last toner image transferred to a copy sheet from being transferred to the transfer drum 37.

Many modifications will become possible for those skilled in the art after receiving the teachings of the present disclosure without departing from the scope thereof. For example, the photoconductive drum may be replaced by a photoconductive belt and the slit exposure unit may be replaced by a flash exposure unit. As another example, the present invention may be utilized in a system where an electrostatic image is developed and the resulting toner image is transferred several times to several respective copy sheets without redevelopment of the electrostatic image.

What is claimed is:

1. An electrophotographic apparatus comprising:

a photoconductive member;

charging means for electrostatically charging the photoconductive member;

exposure means for radiating a light image of a document onto the photoconductive member to form an original electrostatic image thereon;

developing means for applying a toner substance to the photoconductive member to develop the original electrostatic image into a toner image;

transfer means for transferring the toner image to a copy sheet; and control means for controlling the charging means, exposure means, developing means and transfer means in such a manner as to repeatedly develop the original electrostatic image and transfer resulting toner images to respective copy sheets and to charge the photoconductive member and radiate said light image onto the photoconductive member to form a new electrostatic image when a characteristic of the original electrostatic image drops below a predetermined value, the control means comprising an exposure counter means which is stepped each time a toner image is transferred to a copy sheet and decoder means connected to the exposure counter means, the decoder means controlling the charging means and the exposure means to form the new electrostatic image when the exposure counter means has been stepped a predetermined number of times indicating that said characteristic of the original electrostatic image has dropped below the predetermined value.

2. An apparatus as in claim 1, further comprising cleaning means for removing residual toner substance from the photoconductive member, the control means controlling the cleaning means in such a manner as to remove residual toner substance from the photoconductive member before the charging means and exposure means form the new electrostatic image thereon.

3. An apparatus as in claim 2, in which the cleaning means further comprises a discharging means for discharging the photoconductive member.

4. An apparatus as in claim 1, in which the control means comprises a timer means connected to control the charging means and the exposure means to form the new electrostatic image after a predetermined time indicating that the intensity of the original electrostatic image has dropped below the predetermined value.

5. An apparatus as in claim 1, in which the control means comprises a sensor for sensing at least one of voltage and optical density of the original electrostatic image.

6. An apparatus as in claim 1, further comprising a copy counter means which is set to correspond to a number of copies to be made and is stepped each time a toner image is transferred to a copy sheet, an indicator for indicating that a last required electrostatic image of the document has been formed and an indicator control means connected to the exposure counter means, the copy counter means and the control means, the indicator control means energizing the indicator means when the control means simultaneously controls the exposure means to form a new electrostatic image and counts of the exposure and copy counter means have a predetermined relationship.

7. An apparatus as in claim 6, in which the copy counter means is set to the number of copies to be made and is decremented each time a toner image is transferred to a copy sheet, the exposure counter means being set to a number of copies which can be made before said characteristic of the original electrostatic image drops below the predetermined value, the predetermined relationship being such that the count in the copy counter means is lower than the count in the exposure counter means.

8. An apparatus as in claim 1, in which the control means further comprises means to de-energize the developing means after a last required toner image has been formed.

9. An apparatus as in claim 1, in which the photoconductive member is in the form of a rotary drum rotating at constant speed adjacent to the charging means, exposure means, developing means and transfer means.

10. An apparatus as in claim 6, further comprising a shutter actuated by the indicator control means to block an optical path between the exposure means and the photoconductive member simultaneously with energizing the indicator means.

11. An electrophotographic apparatus comprising:

a photoconductive member;

charging means for electrostatically charging the photoconductive member;

exposure means for radiating a light image of a document onto the photoconductive member to form an original electrostatic image thereon;

developing means for applying a toner substance to the photoconductive member to develop the original electrostatic image into a toner image;

transfer means for transferring the toner image to a copy sheet;

cleaning means for removing residual toner substance from the photoconductive member; and control means for consecutively sensing a characteristic of the original electrostatic image and comparing the sensed characteristic of the original electrostatic image with a predetermined value of said characteristic acceptable copies being produced when the sensed characteristic of the original electrostatic image is above the predetermined value, said control means controlling the charging means, exposure means, developing means, transfer means and cleaning means in such a moment as to repeatedly develop the original electrostatic image and transfer resulting toner images to respective copy sheets, to charge the photoconductive member and radiate said light image onto the photoconductive member to form a new electrostatic image when the sensed characteristic of the original electrostatic image is below the predetermined value, and to remove the residual toner substance from the photoconductive member before the charging means and exposure means form the new electrostatic image thereon.

12. An apparatus as in claim 11, in which the voltage of the original electrostatic image is sensed as the characteristic thereof.

13. An apparatus as in claim 11, in which the optical density of the original electrostatic image is sensed as the characteristic thereof.

* * * * *